US005480043A

United States Patent [19]

Wingo

[11] Patent Number: 5,480,043

[45] Date of Patent: Jan. 2, 1996

[54] TWO-HANDLE COLLAR FOR A BABY BOTTLE FOR HELPING THE BABY HOLD AND SUPPORT A BOTTLE WHILE DRINKING THROUGH A NIPPLE

[76] Inventor: Janice P. Wingo, 576 Stratford Ave., St. Louis, Mo. 63130

[21] Appl. No.: 260,776

[22] Filed: Jun. 16, 1994

Related U.S. Application Data

[63] Continuation of Ser. No. 71,186, Jun. 2, 1993, abandoned.

[51] Int. Cl.[6] ..... A61J 9/00; A61J 9/06

[52] U.S. Cl. ..... 215/11.1; 215/396; 220/772

[58] Field of Search ..... 215/100 A, 11.1–11.6, 215/386, 396; 220/772, 759, 769; 294/27.1, 33; D24/197, 198; 248/102

[56] References Cited

U.S. PATENT DOCUMENTS

| | | | |
|---|---|---|---|
| D. 279,752 | 7/1985 | Jagger | D24/197 X |
| D. 298,970 | 12/1988 | Dirks | D24/198 X |
| D. 315,212 | 3/1991 | Oknuki | D24/197 |
| D. 341,892 | 11/1993 | Yagi | D24/197 |
| 1,428,758 | 9/1922 | Cowles | 215/100 A X |
| 1,429,198 | 9/1922 | Fawcett | 248/102 X |
| 1,617,213 | 2/1927 | La Paugh | 215/11.6 |
| 1,890,482 | 12/1932 | Weissberg | 215/100 A |
| 2,789,002 | 4/1957 | Nicholas | 215/11.1 X |
| 3,058,708 | 10/1962 | Murray et al. | 248/102 |
| 3,718,360 | 2/1973 | Knutzen | 215/11.6 X |
| 3,773,287 | 11/1973 | Hechinger | 248/102 |
| 3,990,596 | 11/1976 | Hoftman | 215/100 A X |
| 4,557,392 | 12/1985 | Ryan et al. | 215/100 A X |
| 4,801,027 | 1/1989 | Hunter | 220/711 X |
| 4,887,729 | 12/1989 | Junkman et al. | 215/100 A |
| 4,940,151 | 7/1990 | Fett | 215/100 A X |
| 4,941,579 | 7/1990 | Lee | 215/100 A X |
| 4,943,017 | 7/1990 | Ennis | 215/100 A X |
| 4,971,211 | 11/1990 | Lake | 215/100 A X |
| 5,038,948 | 8/1991 | Signorini | 215/100 A X |
| 5,145,077 | 9/1992 | Rohrig | 215/11.6 X |

FOREIGN PATENT DOCUMENTS

| | | | |
|---|---|---|---|
| 1433209 | 4/1976 | United Kingdom | 215/100 A |
| 2187722 | 9/1987 | United Kingdom | 215/11.6 |

*Primary Examiner*—Sue A. Weaver

*Attorney, Agent, or Firm*—G. Kendall Parmelee; Parmelee, Bollinger & Bramblett

[57] ABSTRACT

A two-handle collar for a baby bottle for helping a baby hold and support the bottle while drinking through a nipple, wherein the bottle has a neck with a mouth at one end and a bottom at the other end. An attachment on the neck is used for mounting a nipple on the mouth. The two-handle collar includes a ring removably mountable on the neck with two handles extending from the ring in first and second directions generally radially outwardly relative to a central longitudinal axis of the bottle. These handles are angularly spaced around the axis by an angular spacing B for convenient grasping by the baby's hands positioned comfortably near opposite sides of the baby's face. Oval-shaped handles provide grasping regions spaced outwardly away from the neck of the bottle for baby's hands to hold onto these grasping regions each of which is oriented at acute angle A relative to the bottle axis. In FIG. 1, a portion of each handle nearer the nipple is shown near the elevation of the axis for pulling the bottle toward the baby's mouth, while a portion of each handle further from the baby's mouth is shown below the axis elevation for convenient grasping and holding for pushing upwardly by the heel and palm of a baby's hand in supporting relationship for providing a supporting torque for tilting the bottle axis upwardly above horizontal in convenient drinking attitude, as illustrated in FIG. 1.

20 Claims, 3 Drawing Sheets

FIG. 1
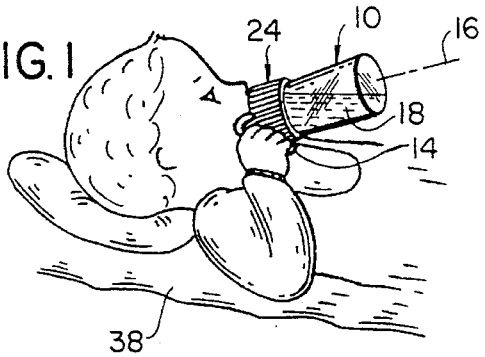
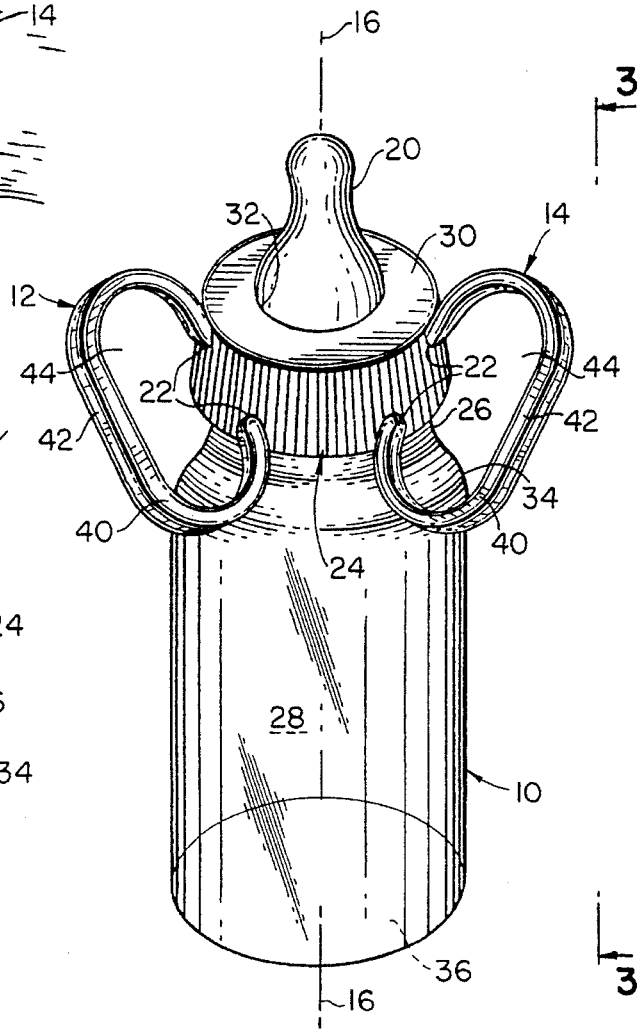
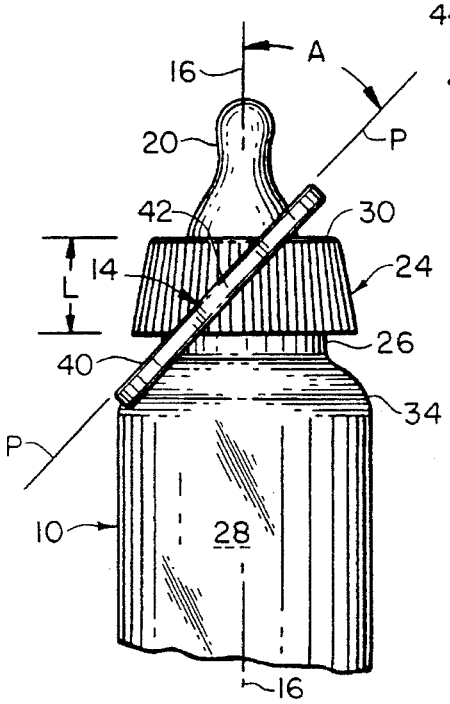
FIG. 3
FIG. 2
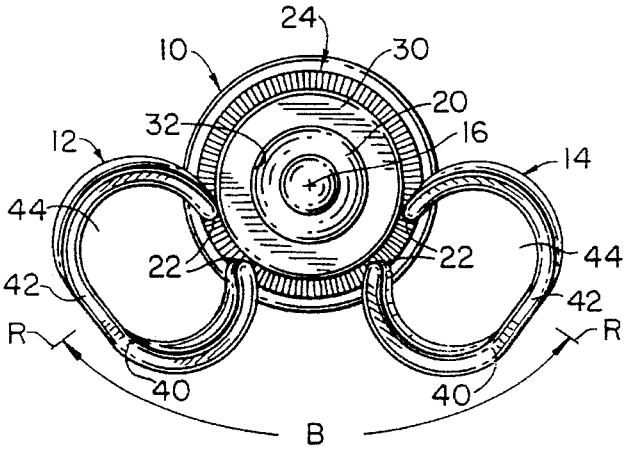
FIG. 4

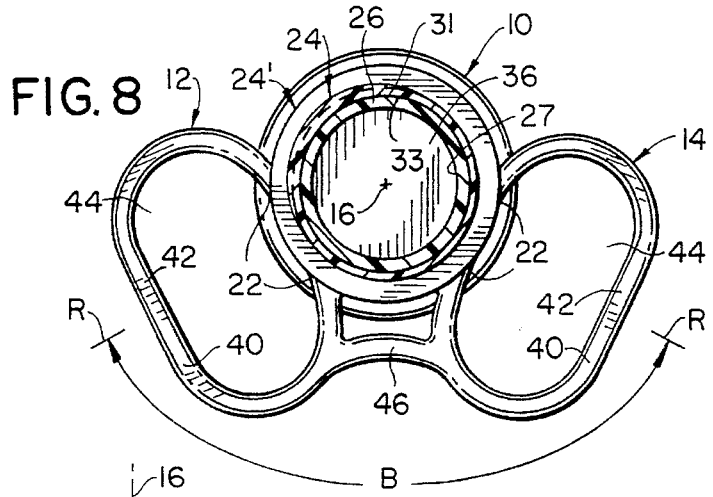
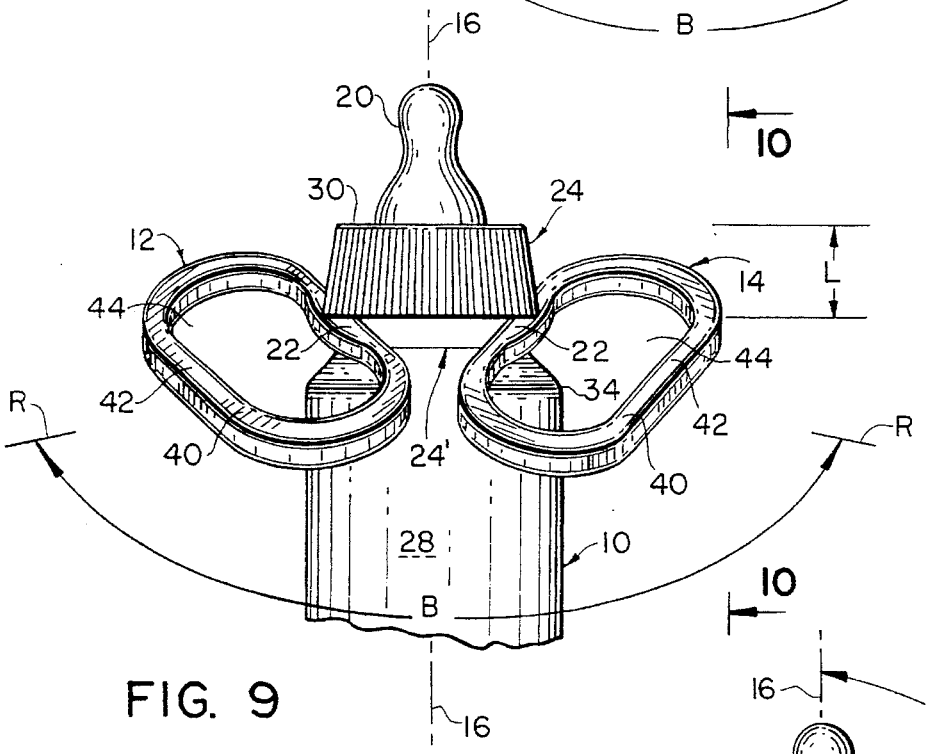
FIG. 9
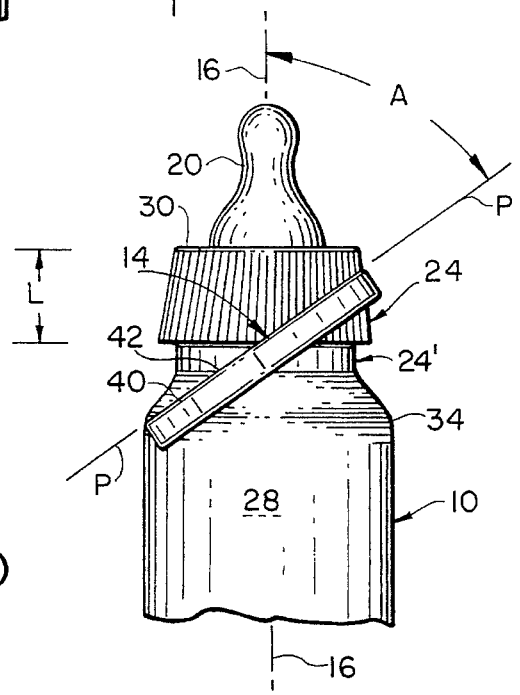
FIG. 10

TWO-HANDLE COLLAR FOR A BABY BOTTLE FOR HELPING THE BABY HOLD AND SUPPORT A BOTTLE WHILE DRINKING THROUGH A NIPPLE

This application is a continuation of prior application Ser. No. 08/071,186 filed Jun. 2, 1993, and now abandoned.

FIELD OF THE INVENTION

The present invention is in the field of equipment for young bottle-fed babies and relates to neck-mounted removable handles for baby bottles, more particularly to a pair of handles mounted by a removable collar positioned around the neck of the bottle.

BACKGROUND

It usually is not possible for a young baby to elevate suitably a baby bottle from which the baby is drinking through a nipple. Thus, without assistance, the milk or other liquid in the bottle often does not flow into the nipple. Some older person needs to prop up the bottle at least to a horizontal position but preferably to an elevation somewhat above horizontal, so that the liquid level will enter into the nipple for the baby to drink. Sometimes the bottle may be propped up temporarily on a small pillow or small rolled up blanket or the like. Often an adult or older sibling holds the bottle elevated at a sufficient angle above horizontal for the baby to drink comfortably from the nipple.

Baby bottle manufacturers have attempted to shape bottles so as to be easier for a baby to hold. Bottles have been made smaller, such as 4-ounce size (120 ml size) for easier holding with the bottom tipped up above horizontal. Longer bottles of 8-ounce or 9-ounce size (240 ml or 270 ml size) have been configured with twin tubular chambers straddling a central hand-hold opening. These twin chambers are joined together near the nipple and are joined at the bottom. However, a young baby when lying down cannot easily reach these twin tubular portions of the bottle and often a baby does not have ability to elevate a full, relatively heavy 8- or 9-ounce bottle to horizontal or above-horizontal orientation for drinking through a nipple. Further, the two tubular chambers are relatively large in diameter, and they extend generally longitudinally along the bottle, which is not a suitable size nor convenient position, nor desirable orientation for grasping by relatively small hands of young babies.

SUMMARY

In accordance with the invention neck-mounted, removable handles are provided for baby bottles. By virtue of being mounted by a removable collar positioned around the neck of a bottle, such handles are convenient and easy for a young baby to grasp and hold in a natural position with the baby's elbows bent and hands positioned normally near left and right sides of the baby's jaw and cheeks, as is shown in FIG. 1.

As an illustrative embodiment of the invention there is shown a two-handle collar for a baby bottle for helping a baby hold and support the bottle while drinking through a nipple on the bottle, wherein the bottle has a neck with a mouth located at a top of the neck on one end of the bottle and has a bottom at the other end opposite from the mouth. The neck and mouth encircle at least one drinking passage communicating with at least one chamber within the bottle for containing liquid, and attachment means are on the neck of the bottle for use in mounting a nipple on the mouth of the bottle communicating with the drinking passage. For clarity of description the bottle is shown with a central longitudinal axis extending through the neck and through the bottom. The two-handle collar comprises ring means for removably mounting on the bottle with the ring means encircling the neck of the bottle. The collar has first handle means secured to the ring means and positioned extending outwardly from the ring means in a first direction generally radially outwardly relative to the central axis. The collar also has second handle means secured to the ring means with the second handle means being positioned extending outwardly from the ring means in a second direction generally radially outwardly relative to the central axis. The first and second handle means are angularly spaced around the axis by an angular spacing sufficient for convenient grasping by left and right hands of a baby positioned comfortably near opposite sides of the baby's jaw, cheeks or neck.

In accordance with the invention in a preferred embodiment, the two handles are oval-shaped each providing a grasping region spaced outwardly away from the neck of the bottle for a baby's hand to grasp. This grasping region extends generally along a line which lies in a plane. The individual planes of the grasping regions of the two oval handles are respectively oriented at an acute angle relative to the central longitudinal axis of the bottle so that a portion of each oval handle nearer to the nipple in the baby's mouth as seen in FIG. 1 is located near the elevation of the axis of the bottle (when the axis is tipped up above horizontal) and a portion of each oval handle further from the nipple (and further from the baby's mouth as seen in FIG. 1) is located below the elevation of the axis (when the axis is tipped up above horizontal) for convenient grasping and holding in supporting relationship by a baby's hands while tilting the axis of the bottle upwardly above horizontal.

In accordance with the invention in a more preferred embodiment, the oval handles are inclined at an acute angle relative to the central longitudinal axis of the bottle. Thus, a portion of each oval handle nearer the nipple is positioned near the elevation of the bottle axis for facilitating pulling inwardly toward the baby's mouth by the index and center fingers of the baby's respective hands. Another portion of each oval handle farther from the nipple is positioned below the bottle axis for facilitating pushing upwardly by the heel and palm of the baby's respective hands. This inward pull by the index and center fingers on the nearer upper portion of each handle, as seen in FIG. 1, in cooperation with the upward push by the heel and palm of the hand on the farther lower portion of each handle provides a supporting torque for elevating the bottle into a convenient drinking attitude as illustrated in FIG. 1.

Among additional advantages of these removable two-handle collars is that they facilitate washing baby bottles, since the handles and bottle can be washed separately in a kitchen dishwasher.

BRIEF DESCRIPTION OF THE DRAWINGS

The invention, together with further objects, features, advantages and aspects thereof, will be more clearly understood from the following detailed description considered in conjunction with the accompanying drawings which are not drawn to scale with the emphasis instead being placed upon clearly illustrating the principles of the invention. Like reference numerals indicate like elements, like components or similar geometric forms throughout the different views.

The accompanying drawings, which are incorporated in and constitute a part of the specification, illustrate four presently preferred embodiments of the invention and, together with the general description set forth above and the detailed description of the preferred embodiments set forth below, serve to explain the principles of the invention. In these drawings:

FIG. 1 shows a baby lying down, with head on a pillow, comfortably and conveniently drinking from a bottle of about 4-ounce size while holding the bottle tipped up above horizontal using a pair of removable handles mounted near the nipple by a collar positioned around the mouth of the bottle in accordance with the invention.

FIG. 2 is an enlarged perspective view of the bottle and removable collar-mounted handles seen in FIG. 1.

FIG. 3 is a side elevation view of the bottle and two-handle collar as seen looking from the right in FIG. 2 generally in the direction indicated by arrows 3—3. FIG. 3 shows that the planes of the respective handles are oriented at an acute angle in relation to the longitudinal axis of the bottle. The bottom of the bottle is shown broken away in FIG. 3 for indicating that the neck-mounted, removable two-handle collar may also be used for larger bottles such as those of 8- or 9-ounce size.

FIG. 4 is a top plan view of the bottle, the nipple and the two-handle collar showing that the two oval-shaped handles are angularly spaced around the axis of the bottle by an angular spacing which is sufficient for convenient grasping by the left and right hands of a baby, with the elbows bent and the hands positioned comfortably near opposite sides of the baby's face and neck.

FIG. 8 is a cross-sectional top view similar to FIG. 6 and generally similar to FIG. 4 and showing that the two handles may be interconnected by a bridging element.

FIG. 9 is a side elevation view similar to FIG. 7 showing another embodiment of ring-collar-mounted handles in which the planes of the respective handles are oriented at an acute angle in relation to the central longitudinal axis of the bottle.

FIG. 10 is a side elevation view as seen looking from the right in FIG. 9 generally in the direction indicated by arrows 10—10.

DETAILED DESCRIPTION OF PREFERRED EMBODIMENTS OF THE INVENTION

Figure 5:
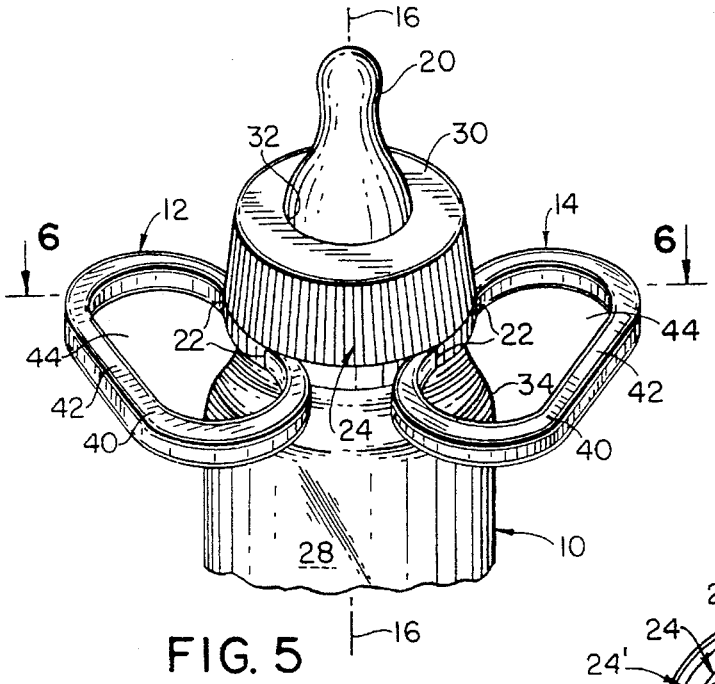
FIG. 5 is a perspective view showing a second embodiment of the invention in which a pair of handles are formed on a ring-shaped collar which encircles the neck of the bottle being captured between a shoulder on the bottle and the screw-on collar which is serving to hold the nipple. The bottom portion of the bottle is shown broken away for illustrating that these ring-collar-mounted handles can be used on various sizes of bottles.

In FIG. 1 is shown the upper body of a baby with a bib lying down on a mattress or other support surface with head on a pillow drinking through a nipple from a bottle 10. The bottle is about a 4-ounce size (about 120 ml). By grasping two collar-mounted, oval-shaped handles 12 and 14 (FIG. 2) the baby is holding the bottle tipped up with its central longitudinal axis 16 inclined upwardly above the elevation of the nipple so that a level of liquid 18 enters the nipple 20 (FIG. 2).

Grasping regions of handles 12 and 14 are conveniently oriented at an acute angle "A" relative to the bottle axis 16 and the handles are spaced around the axis 16 by an angular spacing "B" sufficiently large for convenient grasping by the left and right hands of the baby, while the arms are comfortably positioned with bent elbows. Thus, the hands can be located naturally near opposite sides of the baby's jaw, cheeks or neck as is shown in FIG. 1, which is a usual position of a baby's hands while nursing through a nipple. For clarity of illustration, the other FIGURES of the drawings, except for FIG. 1, show an empty bottle 10.

In this embodiment of the invention the handles 12 and 14 are integrally secured at connections 22 to a side wall of a ring-shaped collar 24 encircling a neck 26 (FIG. 3) of the bottle 10. This collar 24 is shown serving as mounting means by which the nipple 20 is removably mounted onto the mouth (not shown) of the bottle, with the interior of the nipple being in communication with a drinking passage 27 (FIGS. 6 and 8) extending from the mouth of the bottle axially through the neck 26, which is seen in cross-section in FIGS. 6 and 8. The drinking passage connects with a chamber 28 (FIGS. 2 and 3) within the bottle adapted to contain the liquid for drinking. For holding the nipple 20, the collar 24 is shown having an inturned top flange 30 with a central opening 32 through which the nipple is removably insertable. There are attachments 31 (FIGS. 6 and 8) on the neck 26, for example such as screw threads, for use in removably holding the collar 24 around the neck 26 for mounting the nipple. The collar has a suitable internal configuration with attachments 33 for example such as a screw-threaded interior for removable engagement with the attachment means 31 on the neck 26. For example, by turning the collar 24 in one or another direction around the neck 26, the collar may be screwed onto the neck or removed. The neck 26 is joined by a shoulder 34 to the main body of the bottle. For purposes of explanation, FIG. 2 shows the central longitudinal axis 16 of the bottle 10 extending from a central point in the bottom 36 of the bottle.

Inviting attention back to FIG. 1, it is seen that the baby's bent elbows are resting down against a mattress 38 or other suitable soft, resilient body support for the baby, for example such as resilient, soft padding 38 in a carriage, stroller, crib or the like. Thus, the baby's forearm is supported at the elbow by the support 38, and the forearm itself extends generally upwardly like a support column with the baby's hand being conveniently located at the upper end of this support column. The inclination "A" of the handles 12 and 14, and their angular separation "B" enable the palm and heel of the baby's hand on an elbow-supported forearm to press upwardly, almost effortlessly, in supporting relationship against a lower portion 40 and/or grasping region 42 of each handle, while the fingers curl around the grasping region 42 with ends of the fingers entering into an elongated rounded opening 44 provided within each oval-shaped handle. There is sufficient size in the elongated, rounded opening 44 and the grasping region 42 is spaced outwardly sufficiently far from the ring 24 for four of the baby's fingers to be inserted into this opening with the thumb inserted into this opening in the opposite direction from the curled fingers in a holding relationship around the grasping region 42 of each handle.

It is noted that the grasping region 42 of each handle 12 or 14 extends generally along a line which lies in a plane "P—P". As illustratively indicated in FIG. 3, the grasping region 42 of the handle 14 is shown to be extending along a line which lies generally in the plane "P—P" which is oriented at an acute angle "A" relative to the axis 16 of the bottle 10. In a preferred embodiment of the invention, the acute angle "A" for the respective handles is in a range from about 15° to substantially about 90°. In a more preferred embodiment, the acute angle "A" for the respective handles lies within a narrower range from about 25° to about 75°. In a most preferred embodiment, acute angle "A" lies within an even narrower range from about 35° to about 60°. Angle "A" shown in FIG. 3 is about 45°.

These values for preferred, more preferred and most preferred ranges of the acute angles "A" of inclination of the grasping regions 42 of the handles 12 and 14 apply to other embodiments of the invention, for example embodiments as shown in FIGS. 5 through 10.

In order to provide the acute angles of inclination "A" for the respective handles 12 and 14, the upper lobe of each handle is shown to be secured to the generally cylindrical side wall of the collar 24 at an upper connection 22 which is located up on the collar side wall near an upper rim of the collar near its inturned flange 30, and the lower lobe of each handle is shown to be secured to the collar at a lower connection 22 which is located down on the collar side wall near the lower edge of the collar. The collar 24 is shown in FIGS. 1, 2 and 3 as having a generally cylindrical side wall with a significant axial length L, for example an axial length L of at least about ⅜ inch (about 9.5 mm).

From FIG. 2 it will be understood that the upper lobe of each handle is located near the elevation of the bottle axis 16 when the axis is tipped up somewhat above horizontal, as shown in FIG. 1, for example with axis 16 tipped upwardly between about 10° and about 25°. Conversely, the lower lobe of each handle is located below the elevation of the bottle axis when the axis is tipped upwardly somewhat above horizontal, as shown in FIG. 1, thereby facilitating the upward thrust by the heel and palm of the baby's hand on the lower portion 40 of each handle near the grasping region 42.

With reference to FIG. 4, the angular spacing "B" between the handles 12 and 14 around the axis 16 is measured between radii "R" and "R". Each radius "R" extends out from the bottle axis 16 and passes through a middle portion of the outer grasping region 42 of the respective handle 12 or 14. In a preferred embodiment of the invention, this angular spacing "B" is in a range from about 100° to substantially about 180°. In a more preferred embodiment, this angle "B" is in a range from about 105° to about 160°. In a most preferred embodiment, this angle "B" is in a range from about 110° to about 140°. The angle "B" shown in FIG. 4 is 120°.

These values for preferred, more preferred and most preferred ranges for angular separation "B" between handles 12 and 14 apply to other embodiments of the invention for example embodiments as shown in FIGS. 5 through 10.

With reference to the embodiment of the invention in FIGS. 5 through 7, the handles 12 and 14 are shown integrally secured at connections 22 to a ring collar 24' encircling the neck 26 below the nipple-mounting collar 24. This ring collar 24' is captured on the neck 26 being caught between the nipple-mounting collar 24 and the shoulder 34. For example, a nipple-mounting collar 24 with internal screw-threaded attachments 33 may be engaged with screw-threaded attachments 31 on the outside of the neck 26 and then be turned down around the neck for clamping the nipple onto the mount (not shown) at the top of the neck and for simultaneously capturing the ring collar 24' against the shoulder 34. The ring collar 24' is sufficiently thick in the axial direction and is internally configured complementary to the shape of the shoulder 34 for allowing the inturned flange 30 to clamp the nipple in place while the lower edge of the collar 24 is simultaneously capturing the ring collar 24' against this shoulder.

Figure 6:
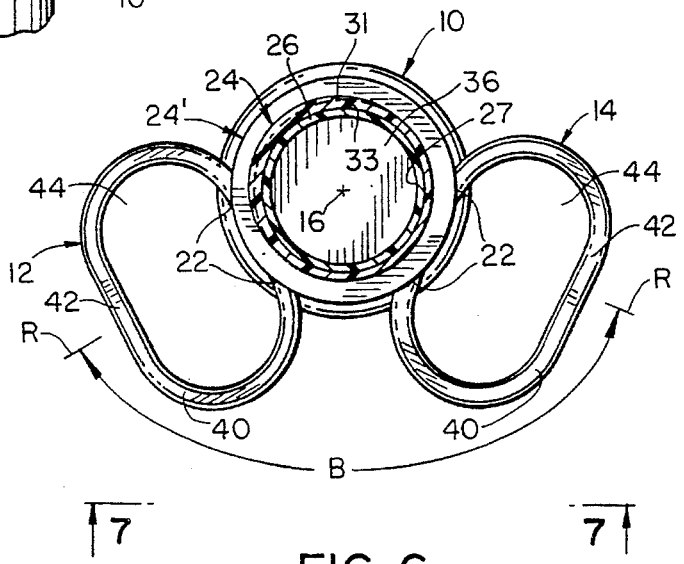
FIG. 6 is a cross sectional top view taken along the plane 6—6 in FIG. 5.
Figure 7:
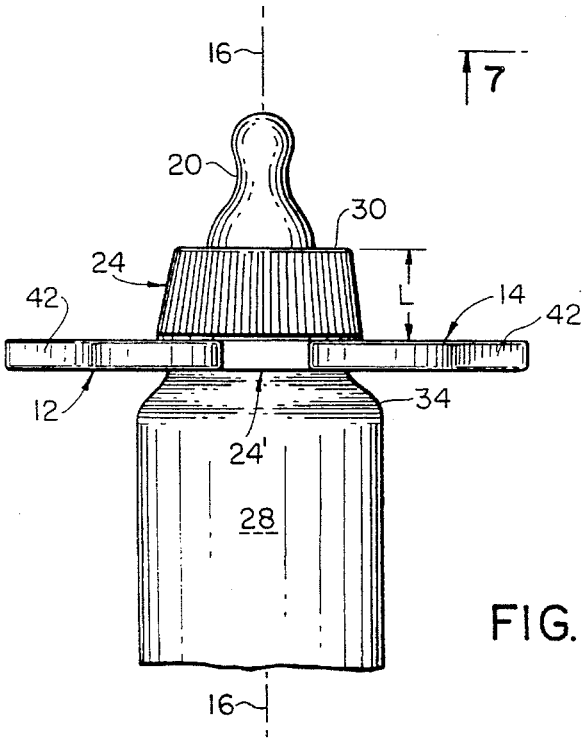
FIG. 7 is a side elevational view of the bottle and ring-collar-mounted handles shown in FIGS. 5 and 6, as seen looking from the direction indicated in FIG. 6 by the arrows 7—7.

In FIG. 6, angular spacing "B" is shown being about 125°. FIG. 7 illustrates that the planes of the handles 12 and 14 may be oriented in a plane corresponding with a plane defined by the ring collar 24'.

Another embodiment of the two-handle collar invention is shown in FIG. 8 including a concave, curved bridging element 46 extending between the lower lobes of the two handles 12 and 14. This bridging element 46 may be used for helping a young baby in holding a bottle tipped up above horizontal, as shown in FIG. 1. This concave bridge 46 may be used to provide auxiliary support action by placing a small rolled-up towel or cloth or the like on the baby's bib with such small rolled-up support being positioned beneath the concave bridge 46. It is noted that such a concave bridging element 46 may be provided on any of the two-handle collars shown in the other FIGURES by interconnecting the lower lobes of the two handles 12 and 14 in a manner similar to bridging interconnection 46 between the lower lobes of the respective handles 12 and 14 in FIG. 8. The ring collar 24' in FIG. 8 is adapted to be held encircling the bottle neck 26, being captured between the nipple-mounting collar 24 and a shoulder 34 on the bottle 10.

A further embodiment of the two-handle collar invention is shown in FIGS. 9 and 10 in which each of the two handles 12 and 14 is integrally secured to a ring collar 24' at a respective connection 22 which is generally centrally located relative to the respective handle 12 or 14. The connection 22 secures each of the handles 12 and 14 inclined at an acute angle "A" (FIG. 10) relative to the central longitudinal axis 16 of the bottle 10. As shown in FIG. 9, the handles 12 and 14 are angularly spaced around the axis 16 by the angular spacing "B".

Since other changes and modifications varied to fit particular human requirements and situations may be recognized by those skilled in the art, the invention is not considered limited to the illustrative examples chosen for purposes of description and includes all changes and modifications which do not constitute a departure from the true spirit and scope of this invention as claimed in the following claims and equivalents thereto.

I claim:

1. A two-handle collar for a baby bottle for helping a baby hold and support the bottle while drinking through a nipple on the bottle, wherein the bottle has a neck with a mouth at a top of the neck on one end of the bottle and the bottle has a bottom on another end opposite from the mouth, and wherein the neck and mouth encircle at least one drinking passage communicating with at least one chamber within the bottle for containing liquid and wherein attachment means are on the neck of the bottle for use in mounting a nipple on the mouth of the bottle with the nipple communicating with the drinking passage and wherein the bottle has a central longitudinal axis extending through the neck and through the bottom and wherein the bottle has a shoulder below the neck, said two-handle collar comprising:

A. ring means for encircling the neck of a baby bottle, said ring means having a central axis and being removably mountable on the bottle neck with said ring means in encircling relationship around the neck of the bottle with said central axis of the ring means aligned with said central longitudinal axis of the bottle;

B. first handle means secured to said ring means;

C. said first handle means being positioned outwardly from said ring means in a first radial direction R generally radially outwardly relative to said central axis of the ring means;

D. second handle means secured to said ring means;

E. said second handle means being positioned outwardly from said ring means in a second radial direction R generally radially outwardly relative to said central axis of said ring means;

F. said first and second radial directions R being angularly spaced around said axis of said ring means by an angular spacing B between said radii R, said angular spacing B being sufficient for convenient grasping by left and right hands of a baby positioned near opposite sides of the baby's face;

G. said first and second handle means including respective first and second grasping regions and each respective handle means having a suitable opening positioned between the grasping region and the ring means and each respective grasping region extending a suitable distance generally in a circumferential direction relative to the central axis of the ring means for allowing four baby's fingers of each hand to be curled around the respective grasping region;

H. each grasping region being spaced outwardly from said ring means by a suitable distance for allowing four baby's fingers of each hand to be curled around the respective grasping region with end portions of the fingers passing through the respective openings between the respective grasping regions and said ring means;

I. said angular spacing B between said radii R being in a range from about 100° to about 180°;

J. said first and second grasping regions extending generally in directions oriented at angle A relative to the central axis of the ring means, said first and second grasping regions each including a first portion adapted to be nearer a baby's face and a second portion adapted to be farther from the baby's face when a nipple mounted on the bottle is in the baby's mouth, said second portion being below the central axis of the ring means for pushing upwardly on said second portion by the heel and palm of the baby's hand in supporting relationship for tilting the bottle axis upwardly above horizontal in convenient drinking attitude when the nipple mounted on the bottle is in the baby's mouth;

K. said angle A being greater than about 15°;

L. said ring means being the sole means to which said first and second handle means are connected;

M. said ring means being removably mountable on the bottle for mounting said first and second handle means on the bottle with said ring means encircling the neck of the bottle below said attachment means with said ring means being restable upon said shoulder and with the ring means becoming captured between the shoulder and nipple-mounting means mountable on the neck of the bottle above said ring means in engagement with said attachment means;

N. said angle A being less than 90° for positioning said first portion of each grasping region above the shoulder of the bottle for being near a baby's face; and O. with each grasping region becoming positioned partially above and partially below the shoulder of the bottle.

2. A two-handle collar for a baby bottle as claimed in claim 1, in which:

P. said first and second handle means as seen looking at the ring means from above the ring means in a direction along the central axis of the ring means are oval-shaped, each oval shape including one of said grasping regions spaced outwardly from said ring means;

Q. each oval shape includes the opening; and

R. said angular spacing B between said radii R is less than 180° and the first portions of the grasping regions as seen looking at the two-handle collar from above the ring means in a direction along the central axis of the ring means are more widely spaced from each other than the second portions of the grasping regions.

3. A two-handle collar for a baby bottle as claimed in claim 2, in which:

S. said angular spacing B between said radii R is in a range from about 105° to about 160°.

4. A two-handle collar for a baby bottle as claimed in claim 2, in which:

S. said angle A is in a range from about 25° to about 75°.

5. A two-handle collar for a baby bottle as claimed in claim 2, in which:

S. said angular spacing B is in a range from about 110° to about 140°.

6. A two-handle collar for a baby bottle as claimed in claim 2, in which:

S. a concave curved bridging element extends between said second portions of said first and second grasping regions.

7. A two-handle collar for a baby bottle as claimed in claim 2, in which:

S. said angle A is in a range from about 35° to about 60°.

8. A two-handle collar for a baby bottle as claimed in claim 1, in which:

P. said angle A is in a range from about 25° to about 75°; and

Q. the first portions of the grasping regions as seen looking at the two-handle collar from above the ring means in a direction along the central axis of the ring means are more widely spaced from each other than the second portions of the grasping regions.

9. Removable handle means for a baby bottle having a neck with a mouth at an upper end of the neck, said removable handle means comprising:

A. ring means for encircling the neck of a baby bottle, said ring means being removably mountable in encircling relationship around the neck of a baby bottle;

B. a first loop-shaped handle secured to said ring means and extending outwardly from said ring means in a first direction;

C. a second loop-shaped handle secured to said ring means and extending outwardly from said ring means in a second direction;

D. said first and second directions being outwardly from the neck of a baby bottle when said ring means are mounted in said encircling relationship around the neck;

E. said first and second directions being angularly spaced around a central axis of said ring means;

F. said first and second loop-shaped handles including respective grasping regions sufficiently large for four fingers of a baby's hand to curl around each of said grasping regions for holding the respective first and second loop-shaped handles;

G. each of said loop-shaped handles including an opening sufficiently large for receiving the ends of the four fingers curled around the respective grasping region;

H. said ring means including a generally cylindrical side wall with a significant axial length L of at least about three-eighths of an inch;

I. the respective grasping regions of the first and second loop-shaped handles being generally inclined relative to the central axis of said ring means at an angle A in a range from about 15° to about 90°;

J. said ring means comprising sole mounting means for removably mounting a nipple onto the mouth of the bottle;

K. each of said first and second loop-shaped handles including an upper lobe and a lower lobe;

L. said ring means serving as the sole connecting means for connecting said first and second handles to the bottle; and M. said lower lobe of each handle being below the central axis of the ring means for pushing upwardly by the heel and palm of a baby's hand in supporting relationship for tilting the bottle upwardly when a nipple mounted by said ring means on the bottle is in the baby's mouth.

10. Removable handle means for a baby bottle as claimed in claim 9, in which:

N. said loop-shaped handles are angularly spaced around the central axis of said ring means by an angular spacing B in a range from about 105° to about 160°; and O. the upper lobes of the loop-shaped handles, as seen looking at said removable handle means from above the ring means in a direction along the central axis of the ring means, are more widely spaced from each other than the Lower lobes of the loop-shaped handles.

11. Removable handle means for a baby bottle as claimed in claim 10, in which:

P. the respective grasping regions of the first and second loop-shaped handles each extend in a direction relative to the axis of said ring means inclined at angle A in a range from about 25° to about 75°; and Q. as seen in side elevational view looking at said removable handle means, the upper lobe of each loop-shaped handle extends above said ring means for being near a baby's face when a nipple mounted onto the mouth of the bottle by said ring means is in the baby's mouth.

12. Removable handle means for a baby bottle as claimed in claim 9, in which:

N. said grasping regions of said first and second loop-shaped handles are generally inclined relative to the axis of the ring means at an angle A in a range from about 25° to about 75°; and O. as seen in side elevational view looking at said removable handle means, the upper lobe of each loop-shaped handle extends above said ring means for being near a baby's face when a nipple mounted onto the mouth of the bottle by said ring means is in the baby's mouth.

13. A pair of handles removably mountable on a baby bottle for helping a young baby hold and support a bottle with the baby's elbows bent and hands positioned normally near left and right sides of the baby's jaw and cheeks while drinking through a nipple on the bottle comprising:

A. a collar mountable on a neck of the bottle above a shoulder of the bottle;

B. a first loop-shaped handle attached to said collar and projecting outwardly from said collar for providing a first grasping region spaced away from the bottle;

C. a second loop-shaped handle attached to said collar and projecting outwardly from said collar for providing a second grasping region spaced away from the bottle;

D. said first and second loop-shaped handles each having an opening sufficiently large for insertion of four fingers of a respective hand of a baby when the fingers are curled around the grasping region in grasping relationship with the thumb inserted through the opening in an opposite direction from the fingers;

E. each of said grasping regions being inclined at angle A relative to a central axis of the collar and being inclined at angle A relative to a central longitudinal axis of the bottle when said collar is mounted on the neck of the bottle;

F. said angle A being in a range from about 15° to about 90°;

G. said collar comprising nipple mounting means for mounting a nipple on a mouth of the neck of the bottle;

H. said collar including a generally cylindrical side wall with significant axial length L of at least about three-eighths of an inch;

I. said first and second loop-shaped handles each including a first lobe adapted to be nearer to a baby's nose and a second lobe adapted to be farther from a baby's nose when a nipple mounted on the bottle is in the baby's mouth;

J. said second lobe of each loop-shaped handle being below a central longitudinal axis of the bottle when said collar is mounted on the neck of the bottle for pushing upwardly by a baby's hand in supporting relationship for tilting the central longitudinal axis of the bottle upwardly above horizontal in a convenient position for drinking from the nipple when the baby is reclining with the nipple in the baby's mouth;

K. said second lobe of each loop-shaped handle being at a position farther from said nipple mounting means than said first lobe;

L. said collar serving as the sole connecting means for connecting the first and second handles to the bottle; and M. at least the first lobe of each handle being above the shoulder of the bottle.

14. A removable pair of handles for a baby bottle as claimed in claim 13, in which:

N. said grasping regions are angularly spaced relative to a central axis of the collar by angular spacing B in a range from 105° to 160°.

15. A removable pair of handles for a baby bottle as claimed in claim 13, in which:

N. said angle A is in a range from about 25° to 75°.

16. A two-handle collar for a baby bottle for helping a baby hold and support the bottle while drinking through a nipple on the bottle, wherein the bottle has a neck with a mouth at a top of the neck on one end of the bottle and the bottle has a bottom on another end opposite from the mouth, and wherein the neck and mouth encircle at least one drinking passage communicating with at least one chamber within the bottle for containing liquid and wherein attachment means are on the neck of the bottle for use in mounting a nipple on the mouth of the bottle with the nipple communicating with the drinking passage and wherein the bottle has a central longitudinal axis extending through the neck and through the bottom, said two-handle collar comprising:

A. ring means for encircling the neck of a baby bottle, said ring means being removably mountable on the bottle neck with said ring means in encircling relationship around the neck of the bottle;

B. first handle means secured to said ring means;

C. said first handle means being positioned outwardly from said ring means in a first radial direction R generally radially outwardly relative to said central axis;

D. second handle means secured to said ring means;

E. said second handle means being positioned outwardly from said ring means in a second radial direction R generally radially outwardly relative to said central axis;

F. said first and second radial directions R being angularly spaced around said axis by an angular spacing B between said radii R, said angular spacing B being sufficient for convenient grasping by left and right hands of a baby positioned near opposite sides of the baby's face;

G. said first and second handle means including respective first and second grasping regions each extending a suitable distance generally in a circumferential direction relative to the central longitudinal axis of a baby bottle for allowing four baby's fingers of each hand to be curled around the respective grasping region;

H. each grasping region being spaced outwardly from said ring means by a suitable distance for allowing four baby's fingers of each hand to be curled around the respective grasping region with end portions of the fingers passing between the respective grasping regions and said ring means;

I. said angular spacing B between said radii R being in a range from about 105° to about 160°;

J. said ring means serve as said attachment means for mounting the nipple on the mouth of the bottle;

K. said ring means include a generally cylindrical side wall with a significant axial length L of at least about three-eighths of an inch;

L. each of said first and second handle means is loop-shaped including an upper lobe and a lower lobe;

M. said upper lobe is secured to said side wall at an upper connection;

N. said lower lobe is secured to said side wall at a lower connection which is located further from the nipple than said upper connection; and O. said ring means serve as the sole connecting means for connecting said first and second handle means to the bottle.

17. A two-handle collar for a baby bottle for helping a baby hold and support the bottle while drinking through a nipple on the bottle, wherein the bottle has a neck with a mouth at a top of the neck and the neck is joined by a shoulder to the main body of the bottle, said two-handle collar comprising:

A. ring means for encircling the neck of a baby bottle, said ring means being removably attachable onto the bottle neck with said ring means in encircling relationship around the neck of the bottle;

B. said ring means having a central axis;

C. said ring means including a generally cylindrical side wall having a significant axial length L of at least about three-eighths of an inch;

D. first loop-shaped handle means secured to said ring means;

E. said first loop-shaped handle means being positioned outwardly from said side wall of the ring means in a first radial direction R generally radially outwardly relative to said central axis of the ring means;

F. second loop-shaped handle means secured to said ring means;

G. said second loop-shaped handle means being positioned outwardly from said side wall of the ring means in a second radial direction R generally radially outwardly relative to said central axis of the ring means;

H. said first and second loop-shaped handle means including respective first and second openings and respective first and second grasping regions each extending a suitable distance for allowing four baby's fingers of each hand to be curled around the respective grasping region;

I. said first and second radial directions R being angularly spaced around said axis by an angular spacing B between said radii R, said angular spacing B being sufficient for convenient grasping of the respective first and second grasping regions by left and right hands of a baby positioned near opposite sides of the baby's face;

J. each grasping region being spaced outwardly from said ring means by a suitable distance for allowing four baby's fingers of each hand to be curled around the respective grasping region with end portions of the fingers passing through the respective opening and with an end portion of the respective thumb passing through the respective opening in the opposite direction from end portions of the fingers;

K. said ring means when attached onto the neck of the bottle serving as sole mounting means for mounting the nipple on the mouth of the bottle;

L. said ring means when attached onto the neck of the bottle serving as sole connecting means for connecting said first and second loop-shaped handle means to the bottle;

M. each of said first and second loop-shaped handle means including an upper lobe and a lower lobe;

N. said upper lobes of said first and second loop-shaped handle means extending above said side wall of the ring means; and O. said lower lobes of said first and second loop-shaped handle means extending below said side wall of the ring means.

18. A two-handle collar for a baby bottle as claimed in claim 17, in which:

said first and second grasping regions are each inclined at an acute angle relative to the central axis of said ring means;

said angular spacing B between said radii R is less than 180°; and said upper lobes of said first and second loop-shaped handle means are more widely spaced from each other than said lower lobes of said first and second loop-shaped handle means.

19. A two-handle collar for a baby bottle as claimed in claim 18, in which:

said first and second grasping regions diverge from each other in an upward direction, wherein upward direction is with respect to direction from the lower lobes toward the upper lobes of the first and second loop-shaped handle means.

20. A two-handle collar for a baby bottle as claimed in claim 17, in which:

said upper lobe is secured to said side wall of said ring means at an upper connection; and said lower lobe is secured to said side wall of said ring means at a lower connection which is farther from a nipple than said upper connection when said ring means is mounting the nipple on the mouth of the bottle.

* * * * *